US012336565B2

(12) United States Patent
Jeong et al.

(10) Patent No.: US 12,336,565 B2
(45) **Date of Patent: *Jun. 24, 2025**

(54) LIQUID CARTRIDGE THAT CAN BE INSERTED INTO ELECTRICALLY HEATED SMOKING ARTICLE, ELECTRICALLY HEATED SMOKING ARTICLE INCLUDING THE SAME, AND AEROSOL GENERATING DEVICE AND SYSTEM THEREFOR

(71) Applicant: INNO-IT CO., LTD., Busan (KR)

(72) Inventors: Seung Kiu Jeong, Gyeongsangnam-do (KR); Hyuk Won, Busan (KR); Seung Joo Han, Gyeonggi-do (KR)

(73) Assignee: INNO-IT CO., LTD., Busan (KR)

( * ) Notice: Subject to any disclaimer, the term of this patent is extended or adjusted under 35 U.S.C. 154(b) by 77 days.

This patent is subject to a terminal disclaimer.

(21) Appl. No.: 17/776,776

(22) PCT Filed: Jan. 28, 2020

(86) PCT No.: PCT/KR2020/001277

§ 371 (c)(1),
(2) Date: Jun. 21, 2023

(87) PCT Pub. No.: WO2020/153828

PCT Pub. Date: Jul. 30, 2020

(65) Prior Publication Data

US 2023/0320419 A1 Oct. 12, 2023

(30) Foreign Application Priority Data

Jan. 24, 2019 (KR) ..... 10-2019-0009335
Aug. 19, 2019 (KR) ..... 10-2019-0101077
(Continued)

(51) Int. Cl.
*A24F 40/42* (2020.01)
*A24B 13/02* (2006.01)
(Continued)

(52) U.S. Cl.
CPC ..... *A24F 40/42* (2020.01); *A24D 3/04* (2013.01); *A24F 40/10* (2020.01); *A24F 40/30* (2020.01);
(Continued)

(58) Field of Classification Search
CPC ..... A24F 40/51; A24F 40/30; A24F 40/57; A24F 40/46; A24F 40/10; A24F 40/42
See application file for complete search history.

(56) References Cited

U.S. PATENT DOCUMENTS 5,240,016 A 8/1993 Nichols et al.
2008/0092912 A1 4/2008 Robinson et al.
(Continued)

FOREIGN PATENT DOCUMENTS

CA 3028880 A1 3/2018
EP 3818866 A1 5/2021
(Continued)

*Primary Examiner* — Alex B Efta
(74) *Attorney, Agent, or Firm* — Murphy, Bilak & Homiller, PLLC

(57) ABSTRACT

The present invention provides a liquid cartridge that can be inserted into an electrically heated smoking article, the liquid cartridge comprising: a liquid composition; an absorbent soaked with the liquid composition; and wrapping paper wrapped around the side of the absorbent in a cylindrical shape measuring 7 to 20 mm long and 5 to 8 mm in diameter, wherein the absorbent has a sufficient absorption rate to absorb 70 to 120 mg of liquid composition and keep the same in the liquid cartridge, and also provides an electrically heated smoking article and an aerosol generating device and system therefor, the electrically heated smoking article comprising: a filter; a liquid cartridge located upstream of the filter; and a tobacco filler containing shredded tobacco located upstream of the filter and located upstream or downstream of the liquid cartridge, wherein the
(Continued)

filter, liquid cartridge, and tobacco filler are wrapped in wrapping paper to form a smoking article.

18 Claims, 12 Drawing Sheets

(30) Foreign Application Priority Data

| | | |
|---|---|---|
| Sep. 27, 2019 | (KR) | 10-2019-0119221 |
| Sep. 27, 2019 | (KR) | 10-2019-0119452 |
| Nov. 21, 2019 | (KR) | 10-2019-0150221 |
| Jan. 28, 2020 | (KR) | 10-2020-0009696 |

(51) Int. Cl.

| | |
|---|---|
| ***A24B 15/167*** | (2020.01) |
| ***A24D 3/04*** | (2006.01) |
| ***A24F 40/10*** | (2020.01) |
| ***A24F 40/30*** | (2020.01) |
| ***A24F 40/46*** | (2020.01) |
| ***A24F 40/51*** | (2020.01) |
| ***A24F 40/57*** | (2020.01) |

(52) U.S. Cl.
CPC ..... *A24F 40/46* (2020.01); *A24F 40/51* (2020.01); *A24F 40/57* (2020.01); *A24B 13/02* (2013.01); *A24B 15/167* (2016.11)

(56) References Cited

U.S. PATENT DOCUMENTS

| | | | | |
|---|---|---|---|---|
| 2011/0120482 | A1* | 5/2011 | Brenneise | A24F 40/48 131/328 |
| 2012/0067360 | A1* | 3/2012 | Conner | A24D 1/22 131/194 |
| 2014/0182611 | A1* | 7/2014 | Liu | A24F 40/40 131/329 |
| 2014/0338686 | A1 | 11/2014 | Plojoux et al. | |
| 2015/0053220 | A1* | 2/2015 | Levy | A24F 40/485 131/329 |
| 2015/0136154 | A1* | 5/2015 | Mitrev | A24D 1/20 131/328 |
| 2015/0230515 | A1 | 8/2015 | Lampe et al. | |
| 2015/0313283 | A1 | 11/2015 | Collett et al. | |
| 2016/0120225 | A1 | 5/2016 | Mishra et al. | |
| 2016/0157523 | A1* | 6/2016 | Liu | H05B 3/44 392/395 |
| 2016/0295926 | A1 | 10/2016 | Zuber | |
| 2016/0374393 | A1* | 12/2016 | Chen | H01R 13/62 131/329 |
| 2017/0006912 | A1 | 1/2017 | Shibagaki et al. | |
| 2017/0042242 | A1* | 2/2017 | Hon | A61M 15/06 |
| 2017/0127725 | A1* | 5/2017 | Buchberger | H05B 1/0244 |
| 2017/0340018 | A1 | 11/2017 | Thorens | |
| 2018/0007972 | A1* | 1/2018 | Thorens | A61M 11/003 |
| 2018/0007974 | A1 | 1/2018 | Thorens | |
| 2018/0015237 | A1 | 1/2018 | Thorens | |
| 2018/0027884 | A1 | 2/2018 | Zuber et al. | |
| 2018/0352862 | A1 | 12/2018 | Mironov et al. | |
| 2020/0093177 | A1* | 3/2020 | Han | A24F 40/90 |

FOREIGN PATENT DOCUMENTS

| | | | |
|---|---|---|---|
| EP | 3900552 | A1 | 10/2021 |
| JP | H05153946 | A | 6/1993 |
| JP | 2009502136 | A | 1/2009 |
| JP | 2016520061 | A | 7/2016 |
| JP | 2020519263 | A | 7/2020 |
| KR | 101323429 | B1 | 10/2013 |
| KR | 20150130457 | A | 11/2015 |
| KR | 101623429 | B1 | 5/2016 |
| KR | 20160093717 | A | 8/2016 |
| KR | 20160096590 | A | 8/2016 |
| KR | 20180007796 | A | 1/2018 |
| KR | 20180010880 | A | 1/2018 |
| KR | 20180117615 | A | 10/2018 |
| KR | 20180135927 | A | 12/2018 |
| KR | 20190093027 | A | 8/2019 |
| WO | 2007012007 | A2 | 1/2007 |
| WO | 2014182736 | A1 | 11/2014 |
| WO | 2016055653 | A1 | 4/2016 |
| WO | 2018019738 | A1 | 2/2018 |
| WO | 2018158566 | A1 | 9/2018 |
| WO | 2018206615 | A2 | 11/2018 |
| WO | 2020130752 | A1 | 6/2020 |

* cited by examiner

LIQUID CARTRIDGE THAT CAN BE INSERTED INTO ELECTRICALLY HEATED SMOKING ARTICLE, ELECTRICALLY HEATED SMOKING ARTICLE INCLUDING THE SAME, AND AEROSOL GENERATING DEVICE AND SYSTEM THEREFOR

TECHNICAL FIELD

The present invention relates to a liquid cartridge that can be inserted into an electrically heated smoking article, an electrically heated smoking article including the same, and an aerosol generating device and system therefor, and more particularly, to a liquid cartridge that can be inserted into an electrically heated smoking article comprising a tobacco substrate, for generating an aerosol by heating instead of burning, and that can generate more aerosol by heating, an electrically heated smoking article including the same, and an aerosol generating device and system therefor.

BACKGROUND ART

In recent years, the demand for alternatives for addressing the shortcomings of traditional cigarettes is increasing. For instance, there is a growing demand for methods of generating an aerosol by heating an aerosol-generating material in a cigarette, instead of burning tobacco.

Typically, a reconstituted tobacco slurry sheet, which is the main ingredient of the tobacco substrate, is not easy to manufacture because of its low tensile strength, and its physical properties are weak because the tobacco substrate contains large amounts of humectants. Moreover, the tobacco substrate contains a liquid such as glycerin and is sensitive to the humidity in the surroundings due to its hydrophilic nature, which makes it difficult to control the environment of the manufacturing process. Also, the tobacco substrate can contain only a limited amount of liquid.

Aside from cigarettes comprising the tobacco substrate, there have been proposed 'hybrid' cigarettes, which generate more aerosol from liquid contained in a cartomizer and let the user inhale an aerosol derived from the liquid when they puff on the cigarette. However, there are difficulties (expiration date, deterioration, etc.) in managing the liquid contained in the cartomizer, and contamination can occur as condensate is generated in the airflow path through which the aerosol created by the cartomizer moves.

This creates a need to provide a liquid into an electrically heated smoking article which is disposed after used once and produce an aerosol from the liquid.

DISCLOSURE OF THE INVENTION

An object of the present invention is to solve the problems occurring in the prior art and provide a liquid cartridge that can be inserted into an electrically heated smoking article, an electrically heated smoking article including the same, and an aerosol generating device and system therefor.

In view of this, the present invention provides a liquid cartridge that can be inserted into an electrically heated smoking article, the liquid cartridge comprising: a liquid composition; an absorbent soaked with the liquid composition; and wrapping paper wrapped around the side of the absorbent in a cylindrical shape measuring 7 to 20 mm long and 5 to 8 mm in diameter, wherein the absorbent has a sufficient absorption rate to absorb 70 to 120 mg of liquid composition and keep the same in the liquid cartridge.

The present invention also provides an electrically heated smoking article comprising: a filter; the above liquid cartridge located upstream of the filter; and a tobacco filler containing shredded tobacco located upstream of the filter and located upstream or downstream of the liquid cartridge, wherein the filter, liquid cartridge, and tobacco filler are wrapped in wrapping paper to form a smoking article.

The present invention also provides an aerosol generating device for the above electrically heated smoking article, which is grippable and portable-sized, the aerosol generating device comprising: a cavity provided in the device into which the smoking article can be inserted; at least one of a resistance heater and an induction heater provided in the device, that can heat the interior or exterior of a liquid cartridge and tobacco filler of the smoking article; a rechargeable battery provided in the device to function as a direct current power source; and a control unit provided in the device to control the heaters by receiving direct current power from the battery.

The present invention also provides an aerosol generating system comprising: the above electrically heated smoking article: and an aerosol generating device comprising: a cavity into which the smoking article can be inserted; at least one of a resistance heater and an induction heater that can heat the interior or exterior of a liquid cartridge and tobacco filler of the smoking article; a rechargeable battery functioning as a direct current power source; and a control unit for controlling the heaters by receiving direct current power from the battery, wherein an aerosol is generated inside the smoking article by inserting the electrically heated smoking article into the cavity and electrically heating the liquid cartridge and tobacco filler of the electrically heated smoking article.

According to one aspect of the present invention, there is provided a liquid cartridge that can be inserted into an electrically heated smoking article, the liquid cartridge comprising: a liquid composition; an absorbent soaked with the liquid composition; and wrapping paper wrapped around the side of the absorbent in a cylindrical shape measuring 7 to 20 mm long and 5 to 8 mm in diameter, wherein the absorbent has a sufficient absorption rate to absorb 70 to 120 mg of liquid composition and keep the same in the liquid cartridge.

The liquid composition may contain glycerin VG and optionally contain glycerin PG, water, and flavorings, and the liquid composition may contain 70 to 100 wt % glycerin VG, 0 to 20 wt % glycerin PG, and 0 to 10 wt % water and further contain flavorings added in an amount that is 10% or less of the total weight of the resulting liquid composition.

The absorbent may be made by crumpling or rolling a strip made of a melamine-based foam resin with a thickness of 2 to 3 mm into a cylindrical shape or by processing a melamine-based foam resin into a cylindrical shape, and optionally have a weight of 0.01 to 0.013 $mg/mm^3$ per unit volume.

The absorbent may be made by crumpling, folding, or rolling pulp or a fabric containing pulp into a cylindrical shape or by processing the same into a cylindrical shape, and optionally have a weight of 0.25 to 0.4 $mg/mm^3$ per unit volume.

The absorbent may be made by crumpling or rolling a cotton woven or non-woven fabric into a cylindrical shape or by processing the same into a cylindrical shape, and optionally have a weight of 0.2 to 0.35 $mg/mm^3$ per unit volume.

The absorbent may be made by crumpling or rolling a bamboo fiber woven or non-woven fabric into a cylindrical shape or by processing the same into a cylindrical shape, and optionally have a weight of 0.15 to 0.25 mg/mm$^3$ per unit volume.

Preferably, the amount of liquid composition absorbed by the absorbent may be 0.13 to 0.32 mg/mm$^3$ per unit volume of the absorbent.

Preferably, the wrapping paper may be made by attaching aluminum foil to paper, and may be wrapped in a cylindrical shape so that the aluminum foil comes into contact with the absorbent.

According to another aspect of the present invention, there is provided an electrically heated smoking article comprising: a filter; the above liquid cartridge located upstream of the filter; and a tobacco filler containing shredded tobacco located upstream of the filter and located upstream or downstream of the liquid cartridge, wherein the filter, liquid cartridge, and tobacco filler are wrapped in wrapping paper to form a smoking article.

Preferably, a paper tube may be provided directly upstream of the filter.

According to yet another aspect of the present invention, there is provided an aerosol generating device for the above electrically heated smoking article, which is grippable and portable-sized, the aerosol generating device comprising: a cavity provided in the device into which the smoking article can be inserted; at least one of a resistance heater and an induction heater provided in the device, that can heat the interior or exterior of a liquid cartridge and tobacco filler of the smoking article; a rechargeable battery provided in the device to function as a direct current power source; and a control unit provided in the device to control the heaters by receiving direct current power from the battery.

Preferably, the resistance heater may be either a pipe heater for heating the exterior of the smoking article or an invasive heater inserted into the smoking article to heat the interior, wherein the pipe heater may heat the liquid cartridge and/or tobacco filler, and the invasive heater may be inserted into the tobacco filler and heat the interior of the tobacco filler.

More preferably, the aerosol generating device may further comprise a temperature sensor provided in the device to sense the temperatures of the heaters, wherein the control unit may control the resistance heater according to a sensed value from the temperature sensor.

Preferably, the induction heater may be either a heat pipe made of a susceptor material that heats the exterior of the smoking article, heated by an excitation coil provided separately in the device, or a heat blade made of a susceptor material that is inserted into the smoking article to heat the interior of the smoking article, wherein the heat pipe may heat the liquid cartridge and/or tobacco filler, and the heat blade may be inserted into the tobacco filler and heat the interior of the tobacco filler.

More preferably, the aerosol generating device may further comprise a temperature obtaining unit provided in the device to obtain the temperature of the induction heater, wherein the control unit may control the electrical current applied to the excitation coil based on an input from the temperature obtaining unit.

According to a further aspect of the present invention, there is provided an aerosol generating system comprising: the above electrically heated smoking article; and an aerosol generating device comprising: a cavity into which the smoking article can be inserted; at least one of a resistance heater and an induction heater that can heat the interior or exterior of a liquid cartridge and tobacco filler of the smoking article; a rechargeable battery functioning as a direct current power source; and a control unit for controlling the heaters by receiving direct current power from the battery, wherein an aerosol may be generated inside the smoking article by inserting the electrically heated smoking article into the cavity and electrically heating the liquid cartridge and tobacco filler of the electrically heated smoking article.

According to the present invention, it is possible to solve the problems occurring in the prior art when the user inhales an aerosol derived from a liquid and an aerosol derived from a tobacco substrate, by providing a liquid cartridge that can be inserted into an electrically heated smoking article and an electrically heated smoking article including the same.

BRIEF DESCRIPTION OF THE DRAWINGS

FIG. 5 schematically shows a cross-section of an aerosol generating device combined with a pipe-shaped resistance heater and an invasive resistance heater according to a first embodiment to which the electrically heated smoking article is applied;

FIG. 6 schematically shows a cross-section of an aerosol generating device having a one-piece, pipe-shaped resistance heater according to a second embodiment to which the electrically heated smoking article is applied;

FIG. 7 schematically shows a cross-section of an aerosol generating device having a two-piece, pipe-shaped resistance heater according to a third embodiment to which the electrically heated smoking article is applied;

FIG. 8 schematically shows a cross-section of an aerosol generating device combined with a pipe-shaped resistance heater and an invasive resistance heater according to a fourth embodiment, different from the first embodiment, to which the electrically heated smoking article is applied;

FIG. 9 schematically shows a cross-section of an aerosol generating device having a heat pipe made of a susceptor material and heated by induction heating and a heat blade made of a susceptor material according to a fifth embodiment to which the electrically heated smoking article is applied;

FIG. 10 schematically shows a cross-section of an aerosol generating device having a heat pipe made of a susceptor material and heated by induction heating and a pipe-shaped resistance heater according to a sixth embodiment to which the electrically heated smoking article is applied;

FIG. 11 schematically shows a cross-section of an aerosol generating device having a one-piece heat pipe made of a susceptor material and heated by induction heating according to a seventh embodiment to which the electrically heated smoking article is applied; and FIG. 12 schematically shows a cross-section of an aerosol generating device having a two-piece heat pipe made of a susceptor material and heated by induction heating according to an eighth embodiment to which the electrically heated smoking article is applied.

BEST MODE FOR CARRYING OUT THE INVENTION

Figure 1:
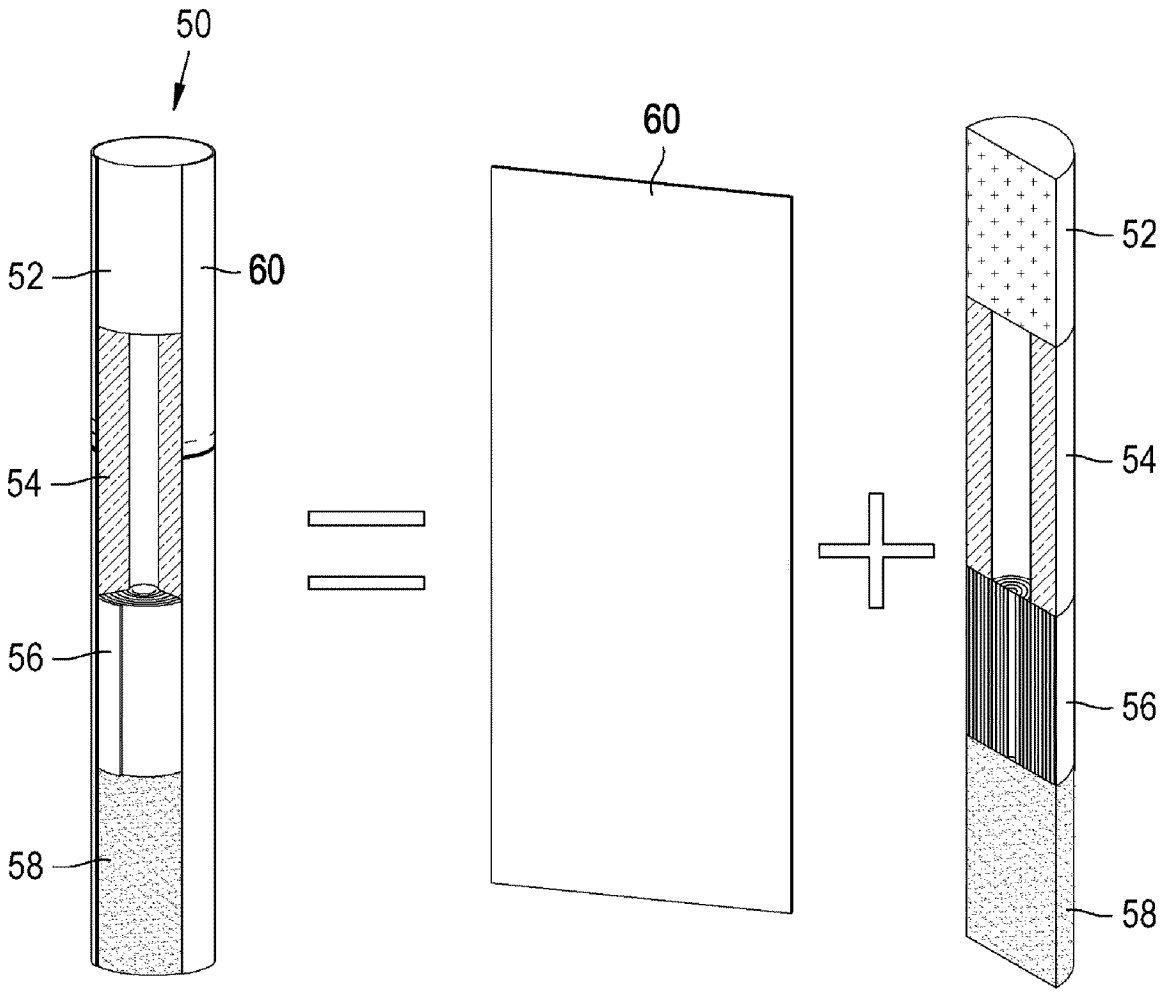
FIG. 1 conceptually shows a partial exploded perspective view and cross-sectional view of an electrically heated smoking article according to a preferred embodiment of the present invention.

Certain embodiments will now be illustrated in the drawings and described in detail in the description, although various changes and modification can be made thereto. Features and advantages of the present invention and the manner of obtaining them will become more apparent by reference to the following description of the embodiments of the invention, taken in conjunction with the accompanying drawings. The present invention may, however, be embodied in different forms and should not be construed as limited to the embodiments set forth herein.

As used herein, the singular forms "a," "an" and "the" are intended to include the plural forms as well, unless the context clearly indicates otherwise.

It will be further understood that the terms "comprises", "comprising", "includes" and/or "including", when used herein, specify the presence of stated features or components, but do not preclude the presence or addition of one or more other features or components.

In the following embodiments, the terms "upstream" and "downstream" are used to describe the relative positions of segments of a smoking article in relation to the direction in which a user draws in air through the smoking article. The smoking article includes an upstream end (through which air enters) and an opposite downstream end (through which air exits). In use, the user draws on the downstream end of the smoking article and inhales air that is drawn through the upstream end of the smoking article, passes through the inside of the smoking article, and goes out to the downstream end. The downstream end is downstream of the upstream end. The term "end" may also be described as "extreme end".

The drawings are not necessarily to scale; some features may be exaggerated or minimized to show details of particular components. Because the size and thickness of each configuration shown in the drawings are arbitrarily shown for better understanding and ease of description, the present invention is not limited thereto.

Example embodiments of the present invention will now be described in detail with reference to the accompanying drawings, so that the present invention can be easily implemented by those skilled in the art. However, the present invention may be implemented in various different ways, without being limited to the described embodiments.

A liquid cartridge which can be inserted into an electrically heated smoking article for generating an aerosol by heating, and an electrically heated smoking article including the liquid cartridge according to a preferred embodiment of the present invention will now be described with reference to the accompanying drawings. For easy explanation, components of the electrically heated smoking article will be described individually, together with a description of the liquid cartridge included therein. Here, the electrically heated smoking article is intended to indicate a smoking article which is heated by electric resistance or induction heating, not by burning, to generate an aerosol for inhalation by a user. The smoking article contains a proper amount of aerosol-forming substrate and/or shredded tobacco to take an equivalent number of puffs to a single traditional cigarette. The smoking article does not generate any more aerosol after generating a preset amount of aerosol and will be discarded by the user after used once.

The electrically heated smoking article according to the present invention comprises a liquid composition, such as typical shredded tobacco and glycerin, as an aerosol-forming substrate, which will be described below. The electrically heated smoking article 50 according to a preferred embodiment of the present invention has a laminate structure composed of a tobacco filler 58 located at the upstream end that contains shredded tobacco as an aerosol-forming substrate, a liquid cartridge 56 located directly downstream thereof as another aerosol-forming substrate that contains a liquid composition, a paper tube 54 located directly downstream thereof that provides an aerosol passage, and a filter 52 functioning as a mouthpiece, all of which are wrapped in wrapping paper 60. The relative positions of the liquid cartridge 56 and the tobacco filler 58 of shredded tobacco may be reversed.

The liquid cartridge 56 according to the present invention comprises: a liquid composition; an absorbent **56*a* soaked with the liquid composition; and wrapping paper 61 wrapped around the side of the absorbent in a cylindrical shape measuring 7 to 20 mm long and 5 to 8 mm in diameter, wherein the absorbent has a sufficient absorption rate to absorb 70 to 120 mg of liquid composition and keep it in the liquid cartridge 56. The cylindrical shape measuring 7 to 20 mm long and 5 to 8 mm in diameter meets the standard for regular cigarettes or electrically heated smoking articles being currently used. When the liquid cartridge 56 of the above standard is inserted into the electrically heated smoking article 50 and wrapped in a separate piece of wrapping paper 60**, the user will see no difference between the regular cigarettes and the electrically heated smoking articles.

Since the shredded tobacco **58*a* in itself cannot maintain its form, it is wrapped in a separate piece of wrapping paper 62 to form the tobacco filler 58. Also, the shredded tobacco 58*a* is prepared in the same size as the liquid cartridge 56, and the aforementioned filter 52, paper tube 54, liquid cartridge 56, and tobacco filler 58 are wrapped in the wrapping paper 60, thereby obtaining the electrically heated smoking article 50 shown in FIG. 1**.

The present invention is characterized in that the absorbent of the liquid cartridge 56 of the above standard absorbs 70 to 120 mg of liquid composition, and this numerical range indicates the amount of liquid composition that provides an aerosol derived from the liquid composition as well when the user inhales an aerosol from the tobacco filler 58 of shredded tobacco in a single cigarette stick for the electrically heated smoking article. If the amount of liquid composition absorbed by the absorbent **56*a* is less than the above lower limit (70 mg), the amount of aerosol derived from the liquid composition when the user inhales an aerosol from the tobacco filler 58 of shredded tobacco in the electrically heated smoking article would be insufficient. Thus, the amount of liquid composition absorbed by the liquid cartridge 56 should be equal to or greater than the above lower limit (70 mg). If the amount of liquid composition absorbed by the absorbent 56*a* exceeds the above upper limit (120 mg), it would be difficult to keep the liquid composition absorbed in the absorbent in the liquid cartridge of the above standard, causing the liquid composition to flow out of the liquid cartridge 56**. Thus, the amount of liquid composition absorbed by the liquid cartridge should be equal to or less than the above upper limit (120 mg). A desirable range is between 80 and 110 mg, and a more desirable range is between 90 and 105 mg.

Another characteristic of the present invention is that the absorbent in the liquid cartridge 56 of the above standard has a sufficient absorption rate to keep the liquid composition having the above range in the liquid cartridge. That is, the liquid composition remains absorbed in the absorbent in the liquid cartridge, without flowing out of the liquid cartridge. Here, the absorption means that the absorbent is soaked with the liquid composition which does not flow out. As described below, the filter 52, paper tube 54, liquid cartridge 56, and tobacco filler 58 are wrapped in the wrapping paper 60 to form the electrically heated smoking article 50, wherein the liquid cartridge 56 is brought into direct contact with the tobacco filler 58, paper tube 54, or filter 52 without a separate member upstream or downstream, and the liquid composition absorbed by the absorbent 56*a* in the liquid cartridge 56 is stored in the absorbent 56*a*, but does not flow out toward the tobacco filler 58, paper tube 54, or filter 52. To this end, the amount of liquid composition absorbed by the absorbent 56*a* is preferably 0.13 to 0.32 mg/mm$^3$ per unit volume of the absorbent 56*a*. This numerical limitation is set for a similar reason to why the numerical limitation is set on the amount of liquid composition absorbed by the absorbent of the present invention. That is, if the amount of liquid composition absorbed by the absorbent 56*a* is not sufficient, i.e., less than the above lower limit (0.13 mg/mm$^3$), the amount of aerosol derived from the liquid composition when the user inhales an aerosol from the shredded tobacco in the electrically heated smoking article 50 would be insufficient. Thus, the amount of liquid composition absorbed by the liquid cartridge should be equal to or greater than the lower limit (0.13 mg/mm$^3$). If the amount of liquid composition absorbed by the absorbent exceeds the above upper limit (0.32 mg/mm$^3$), it would be difficult to keep the liquid composition absorbed in the absorbent in the liquid cartridge of the above standard, causing the liquid composition to flow out of the liquid cartridge.

The liquid composition contains glycerin VG and optionally contains glycerin PG, water, and flavorings. The liquid composition contains 70 to 100 wt % glycerin VG, 0 to 20 wt % glycerin PG, and 0 to 10 wt % water and further contains flavorings added in an amount that is 10% or less of the total weight of the resulting liquid composition. According to a preferred embodiment, the present invention uses a liquid composition made of 100 wt % glycerin VG. According to another preferred embodiment, the present invention uses a liquid composition made of 80 wt % glycerin VG and 20 wt % glycerin PG. According to a further preferred embodiment, the present invention uses a liquid composition made of 75 wt % glycerin VG, 20 wt % glycerin PG, and 5 wt % water. According to a yet further preferred embodiment, the present invention further contains flavorings added in an amount that is 10% or less of the total weight of the resulting liquid composition. For example, the flavorings may include licorice, sucrose, fructose syrup, isosweet, cocoa, lavender, cinnamon, cardamom, celery, cascarilla, fenugreek, cascarilla, sandalwood, bergamot, geranium, honey essence, rose oil, vanilla, lemon oil, orange oil, mint oil, caraway, cognac, jasmine, chamomile, menthol, ylang-ylang, salvia, spearmint, ginger, coriander, or coffee, etc. In addition, the liquid composition may or may not contain nicotine.

Figure 2:
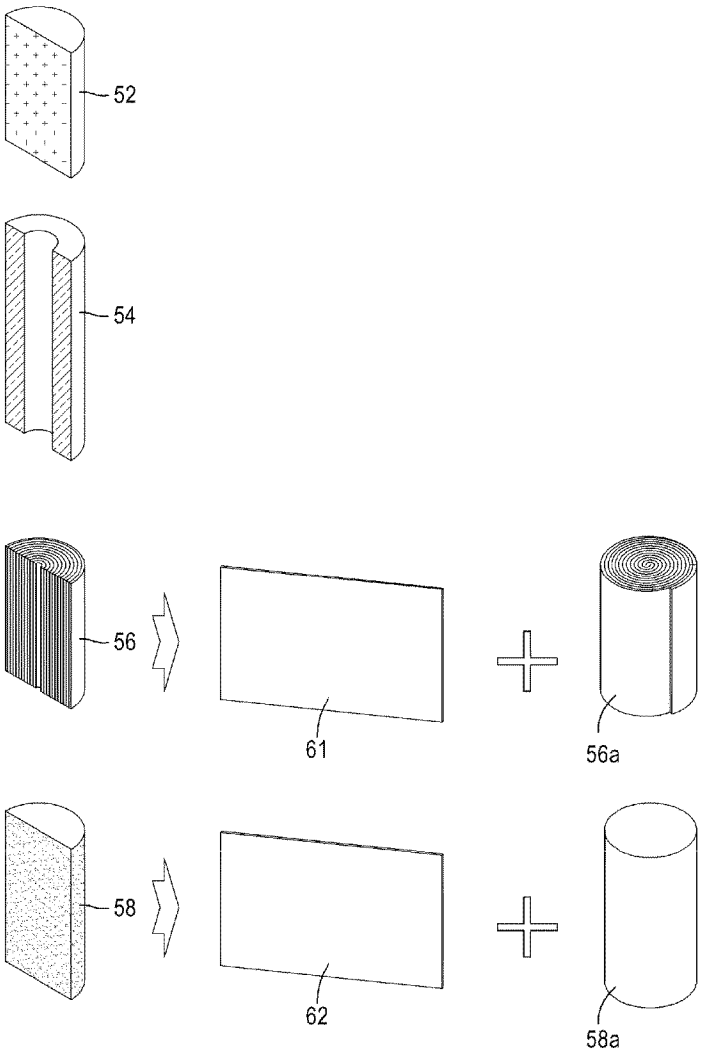
FIG. 2 conceptually shows components of the smoking article of FIG. 1 and a construction of wrapping paper wrapped around them.

According to the present invention, the absorbent 56*a* may be made of various materials. Although FIGS. 1 and 2 illustrate that the absorbent 56*a* is formed in a rolled shape, this is only for convenience of description and the construction of the absorbent 56*a* is not limited thereto. Various types of absorbents 56*a* may be considered as stated below. Basically, an absorbent rod 57 may be obtained by crumpling or rolling the absorbent 56*a*, inserting it through one side of a pipe structure 40 shown in FIG. 3, pressing it into a shape with a narrower cross-section through the other side, and wrapping it in the wrapping paper 61. Before the absorbent 56*a* is inserted into the pipe structure 40, the liquid composition is provided into the absorbent 56*a* through a liquid composition injection part such as a needle. As the absorbent 56*a* passes through the pipe structure 40, it becomes dampened with the liquid composition, and is then wrapped in the wrapping paper 61 immediately on the other side of the pipe structure 40 and cut to an appropriate length, for example, 80 mm to 140 mm, thereby forming the absorbent rod 57. Thus, the absorbent rod 57 comes in the form of the absorbent 56*a* dampened with the liquid composition being wrapped in the wrapping paper 61. As stated later, the absorbent rod 57 is cut to a size that fits into an individual smoking article 50.

This construction is a generalized process in existing cigarette manufacturing lines, and has the advantage of using existing cigarette manufacturing processes and equipment. That is, the same process above applies to the conventional manufacturing of filters, paper tubes, and shredded tobacco, and the cartridge 56 can be produced using the equipment and processes currently used.

According to a preferred embodiment, the absorbent 56*a* of the present invention is made by crumpling or rolling a strip made of a melamine-based foam resin with a thickness of 2 to 3 mm and inserting it into the above-mentioned pipe structure 40 to form a cylindrical shape. According to another preferred embodiment, the absorbent of the present invention is made by processing a melamine-based foam resin into a cylindrical shape and inserting and pressing it into the above-mentioned pipe structure 40, and more preferably, the absorbent made of the melamine-based foam resin has a weight of 0.01 to 0.013 mg/mm$^3$ per unit volume. According to test results for the electrically heated smoking article including the liquid cartridge having the absorbent soaked with 100 mg of liquid composition, the liquid composition remained absorbed in the absorbent without flowing out, during the test, a much greater amount of aerosol than in the existing heated cigarettes was observed, and a sufficient amount of aerosol derived from the liquid composition was observed, even compared to the existing hybrid types.

According to a further preferred embodiment, the absorbent of the present invention is made by crumpling, folding, or rolling pulp or a fabric containing pulp and inserting it into the above-mentioned pipe structure 40 to form a cylindrical shape or by processing it into a cylindrical shape and inserting and pressing it into the above-mentioned pipe structure 40, and more preferably, the absorbent made of pulp or a fabric containing pulp has a weight of 0.25 to 0.4 mg/mm$^3$ per unit volume. According to test results for the electrically heated smoking article including the liquid cartridge having the absorbent soaked with 100 mg of liquid composition, the liquid composition remained absorbed in the absorbent without flowing out, during the test, a much greater amount of aerosol than in the existing heated cigarettes was observed, and a sufficient amount of aerosol derived from the liquid composition was observed, even compared to the existing hybrid types.

According to a yet further preferred embodiment, the absorbent of the present invention is made by crumpling or rolling a cotton woven or non-woven fabric and inserting it into the above-mentioned pipe structure 40 to form a cylindrical shape or by processing it into a cylindrical shape and inserting and pressing it into the above-mentioned pipe structure 40, and more preferably, the absorbent made of a cotton woven or non-woven fabric has a weight of 0.2 to 0.35 mg/mm$^3$ per unit volume. According to test results for the electrically heated smoking article including the liquid cartridge having the absorbent soaked with 100 mg of liquid composition, the liquid composition remained absorbed in the absorbent without flowing out, during the test, a much greater amount of aerosol than in the existing heated cigarettes was observed, and a sufficient amount of aerosol derived from the liquid composition was observed, even compared to the existing hybrid types.

According to a yet further preferred embodiment, the absorbent of the present invention is made by crumpling or rolling a bamboo fiber woven or non-woven fabric and inserting it into the above-mentioned pipe structure 40 to form a cylindrical shape or by processing it into a cylindrical shape and inserting and pressing it into the above-mentioned pipe structure 40, and more preferably, the absorbent made of a bamboo fiber woven or non-woven fabric has a weight of 0.15 to 0.25 mg/mm$^3$ per unit volume. According to test results for the electrically heated smoking article including the liquid cartridge having the absorbent soaked with 100 mg of liquid composition, the liquid composition remained absorbed in the absorbent without flowing out, during the test, a much greater amount of aerosol than in the existing heated cigarettes was observed, and a sufficient amount of aerosol derived from the liquid composition was observed, even compared to the existing hybrid types.

According to a preferred embodiment, the wrapping paper 61 forming the liquid cartridge 56 may come in the form of laminated paper made by attaching aluminum foil to paper, and is wrapped in a cylindrical shape so that the aluminum foil comes into contact with the absorbent 56*a*. Thus, the aluminum foil may eliminate or minimize the possibility that the liquid composition dampening the absorbent 56*a* may flow out through the side of the liquid cartridge 56. That is, as can be seen from the construction of the liquid cartridge shown in FIGS. 1 and 2, the absorbent 56*a* is wrapped in a separate piece of wrapping paper 61 before it is wrapped in the wrapping paper 60 used to form the smoking article. In this case, the wrapping paper 61 may come in the form of paper with aluminum foil attached to it, and it is desirable that the absorbent 56*a* be wrapped in a cylindrical shape so that the aluminum foil comes into contact with the absorbent 56*a*.

The tobacco filler 58 may contain tobacco-based solid substances such as reconstituted tobacco and shredded tobacco. In one embodiment, the tobacco filler 58 may be stuffed with a corrugated reconstituted tobacco sheet. The reconstituted tobacco sheet may have corrugations as it is substantially horizontally rolled around the axis of cylinder, folded, compressed, or shrunken. The porosity may be determined by adjusting the gaps between the corrugations of the reconstituted tobacco sheet.

In another embodiment, the tobacco filler 58 may be stuffed with shredded tobacco. Here, the shredded tobacco may be formed by finely cutting a tobacco sheet (or reconstituted tobacco slurry sheet). Also, the tobacco filler 58 may be formed by combining multiple strands of tobacco together in the same direction (parallel) or randomly. Specifically, the tobacco filler 58 may be formed by combining multiple strands of tobacco together, and may have a plurality of longitudinal channels through which aerosol can pass. The longitudinal channels may be regular or irregular depending on the size and arrangement of the strands of tobacco.

The tobacco filler 58 may additionally comprise at least one among ethylene glycol, dipropylene glycol, diethylene glycol, triethylene glycol, tetraethylene glycol, and oleyl alcohol. The tobacco filler may further comprise glycerin and propylene glycol.

Furthermore, the tobacco filler 58 may contain other additives such as flavorings and/or organic acids. Examples of the flavorings may include licorice, sucrose, fructose syrup, isosweet, cocoa, lavender, cinnamon, cardamom, celery, fenugreek, cascarilla, sandalwood, bergamot, geranium, honey essence, rose oil, vanilla, lemon oil, orange oil, mint oil, caraway, cognac, jasmine, chamomile, menthol, ylang-ylang, salvia, spearmint, ginger, coriander, coffee, etc. Meanwhile, a tobacco substrate receiving portion 11*a* and 11*b* may partially contain glycerin or propylene glycol.

As shown in FIGS. 1 and 2, the electrically heated smoking article 50 according to the present invention may comprise the paper tube 54 for providing an aerosol passage, wherein PLA may be inserted into the tube to reduce the temperature of the aerosol to prevent the user from getting burned when inhaling the aerosol. The paper tube 54 also may be wrapped in a separate piece of wrapping paper (not shown). In this case, regular paper will suffice as the wrapping paper for the paper tube 54.

As shown in FIGS. 1 and 2, the filter 52 functioning as a mouthpiece allows aerosol to pass therethrough and blocks the inflow of liquid. As stated above, the liquid composition soaking through or dampening the absorbent 56*a* is kept within the liquid cartridge 56 in a normal and typical usage environment, but the liquid composition may partially flow out in an abnormal environment, such as when excessive external force is applied only to the liquid cartridge 56, in which case the filter serves to prevent the inflow of liquid (the paper tube may function similarly). The filter may be made of pulp in a cylindrical or tube shape. On the other hand, the filter may contain a flavoring component to increase the user's satisfaction. Examples of the flavoring component may include licorice, sucrose, fructose syrup, isosweet, cocoa, lavender, cinnamon, cardamom, celery, cascarilla, fenugreek, cascarilla, sandalwood, bergamot, geranium, honey essence, rose oil, vanilla, lemon oil, orange oil, mint oil, caraway, cognac, jasmine, chamomile, menthol, ylang-ylang, salvia, spearmint, ginger, coriander, or coffee, etc.

Basically, the above-described liquid cartridge 56 may be made by employing the same process and equipment used to add a flavoring component to the filter 52. In this case, there will be no significant difficulties in achieving mass production and quality control since the existing process and equipment are used.

The electrically heated smoking article 50 is usually wrapped in wrapping paper 60, 61, and 62 composed of multiple layers, such as first wrapping paper 61 wrapped around the liquid cartridge, second wrapping paper 62 wrapped around the liquid cartridge and the tobacco filler of shredded tobacco altogether, downstream or upstream from the first wrapping paper 61, third wrapping paper (not shown) wrapped around the liquid cartridge, the tobacco filler of shredded tobacco, and the tube altogether, and fourth wrapping paper 60 wrapped around the whole parts of the electrically heated smoking article. In this manner, the electrically heated smoking article can be obtained through a number of stages of wrapping. In some cases, a process of forming the liquid cartridge can be carried out separately or through a continuous line.

Alternatively, in order to reduce the manufacturing time and cut down the manufacturing cost, packaging of different materials or different thicknesses may be added to the inside of the outermost wrapping paper wrapped around the whole parts of the electrically heated smoking article to wrap them altogether.

As shown in FIGS. 1 and 2, in the liquid cartridge 56 according to one embodiment of the present invention, the absorbent 56*a* with the liquid composition absorbed in it is wrapped in the wrapping paper 61 serving as a housing. In addition, the paper tube 54 and the filter 52 are stacked sequentially at the downstream end of the liquid cartridge 56. The filter and the paper tube are wrapped in the wrapping paper 60, together with the liquid cartridge.

The liquid composition in the liquid cartridge 56 remains absorbed in the absorbent in the liquid cartridge 56, without flowing out of the liquid cartridge, and is vaporized by heating to generate an aerosol.

Preferably, the wrapping paper 60, 61, and 62 is made of a material that does not deform when heated to a high temperature or when in contact with liquid, or that does not generate harmful components. Alternatively, the wrapping paper may be made of a metal thin film or metal foil, or, as described above, may be made by adding a metal thin film or thin metal sheet to wrapping paper or by laminating them together. According to a preferred embodiment of the present invention, the wrapping paper 61 serving as a housing for the liquid cartridge 56 is composed of paper and aluminum foil laminated together, and the aluminum foil adjoins the absorbent 56*a* and therefore prevents the liquid composition absorbed in the absorbent from flowing out to the side of the liquid cartridge 56.

The filter 52 provided downstream of the liquid cartridge 56 may have a hollow portion for generating an airflow, but a filter with no hollow portion may also be used. The filter may be composed of one or more segments and may include at least one of a tube filter, a cooling structure and a recess filter, for example. The tube filter has an inner hollow portion. The tube filter and the recess filter may be made of cellulose acetate, and the tube functioning as the cooling structure may be made of pure polylactic acid (PLA) or a combination of polylactic acid and another degradable polymer.

More specifically, the filter 52 may be made of acetate, paper, PP, etc. and the wrapping paper wrapped around the filter may be classified as regular paper, porous paper, perforated paper, non-wrapped acetate (NWA), etc. In addition, the filter type may be classified as a mono filter composed of one segment or a composite (double, triple, etc.) filter composed of a number of segments. The filter may be made from acetate tow, plasticizer, activated charcoal, X-DNA, and wrapping paper. The acetate tow refers to an aggregate of continuous filaments of cellulose acetate, which plays a major role in determining draw resistance, which is the most important characteristic of the filter. The properties of the acetate tow are determined by denier.

The plasticizer makes cellulose acetate fibers soft and flexible to form bonds at the contact points between the fibers and make a fiber bundle more rigid. Triacetin is used as a plasticizer for cigarette filters.

The activated charcoal, which is one of the absorbents, contains carbon as the main constituent and can be classified by particle size and nature. Source materials used for the activated charcoal include plant materials, such as wood, sawdust, and fruit stones (coconut husk, bamboo, peach seeds, etc.).

X-DNA refers to functional particles that are extracted from sea algae and then condensed and processed. As compared with the activated charcoal mainly used for cigarette filters, X-DNA does not affect the taste of cigarettes and exhibits strong anticarcinogenic effects.

The wrapping paper 60 serves to maintain the shape of a filter plug during the manufacture of the filter. The wrapping paper is required to satisfy physical properties, such as porosity, tensile strength, extension, thickness, glue adhesion, etc., in its manufacture.

For example, the liquid cartridge 56 may be 14.0 mm long, the filter 52 or the tube 54 may be 2.5 mm long, and the tobacco filler 58 containing shredded tobacco may be 9.0 mm long. Alternatively, for example, the filter may be 10 mm, the paper tube 54 may be 16 mm, the liquid cartridge 56 may be 10 mm, and the tobacco filler 58 may be 12 mm.

The relative lengths of the filter 52, paper tube 54, liquid cartridge 56, and tobacco filler 58 and the relative positioning of the liquid cartridge 56 and tobacco filler 58 may be associated with the temperature of an aerosol the user inhales that is generated from the electrically heated smoking article by means of an aerosol generating device 100 to be described later. The temperature of an aerosol generated from the liquid cartridge 56 and the temperature of an aerosol generated from the tobacco filler 58 are different, and high-temperature aerosol can be cooled further as the paper tube 54 becomes longer. Thus, the temperatures of aerosols generated from the liquid cartridge 56 and tobacco filler 58 and the relative positioning of the liquid cartridge 56 and tobacco filler 58 may be taken into account, and the relative lengths and positioning of the liquid cartridge 56 and tobacco filler 58 may vary with the amounts of liquid composition and shredded tobacco dependent on the volumes of the liquid cartridge 56 and tobacco filler 58 and the heating method used by the aerosol generating device to be described later. It would not be difficult for a person of ordinary skill in the art to satisfy the above conditions when making an electrically heated smoking article the same size as the electrically heated smoking articles currently on the market.

Figure 3:
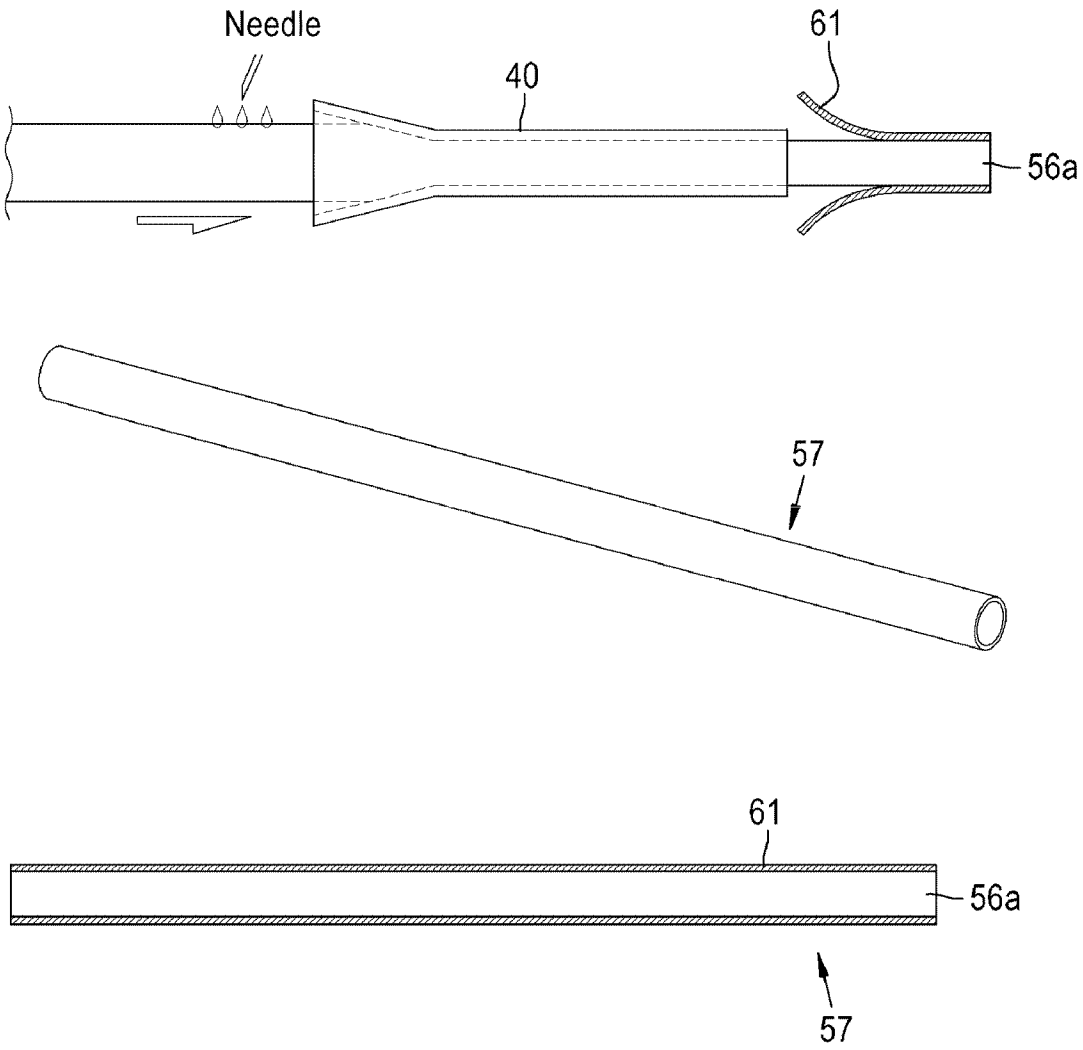
FIG. 3 is a conceptual diagram showing a process of manufacturing an absorbent rod in order to obtain the absorbent of FIG. 2.

As described above, according to a preferred embodiment for manufacturing the liquid cartridge 56 shown in FIG. 3, an absorbent formed in a cylinder shape by the pipe structure 40 is passed through spray equipment or a liquid composition injection part such as a needle before it is inserted into the pipe structure 40, and enough of the liquid composition is sprayed or injected into the absorbent 56*a*, and the absorbent 56*a* becomes dampened or soaked with the liquid composition as it passes through the pipe structure 40. Afterwards, the absorbent with the liquid composition absorbed in it is wrapped in, for example, wrapping paper (or a laminate of paper and aluminum foil), and cut to a required length (for example, 140 mm, 100 mm, or 80 mm) to form an absorbent rod 57. As described later, the absorbent rod 57 may be cut up into a liquid cartridge 56 of a desired length (for example, 14 mm, 10 mm, or 8 mm), and then packed (wrapped) together with other segments (the tube, filter, and tobacco filler) of the electrically heated smoking article, thereby making an electrically heated smoking article 50 for generating an aerosol.

Figure 4:
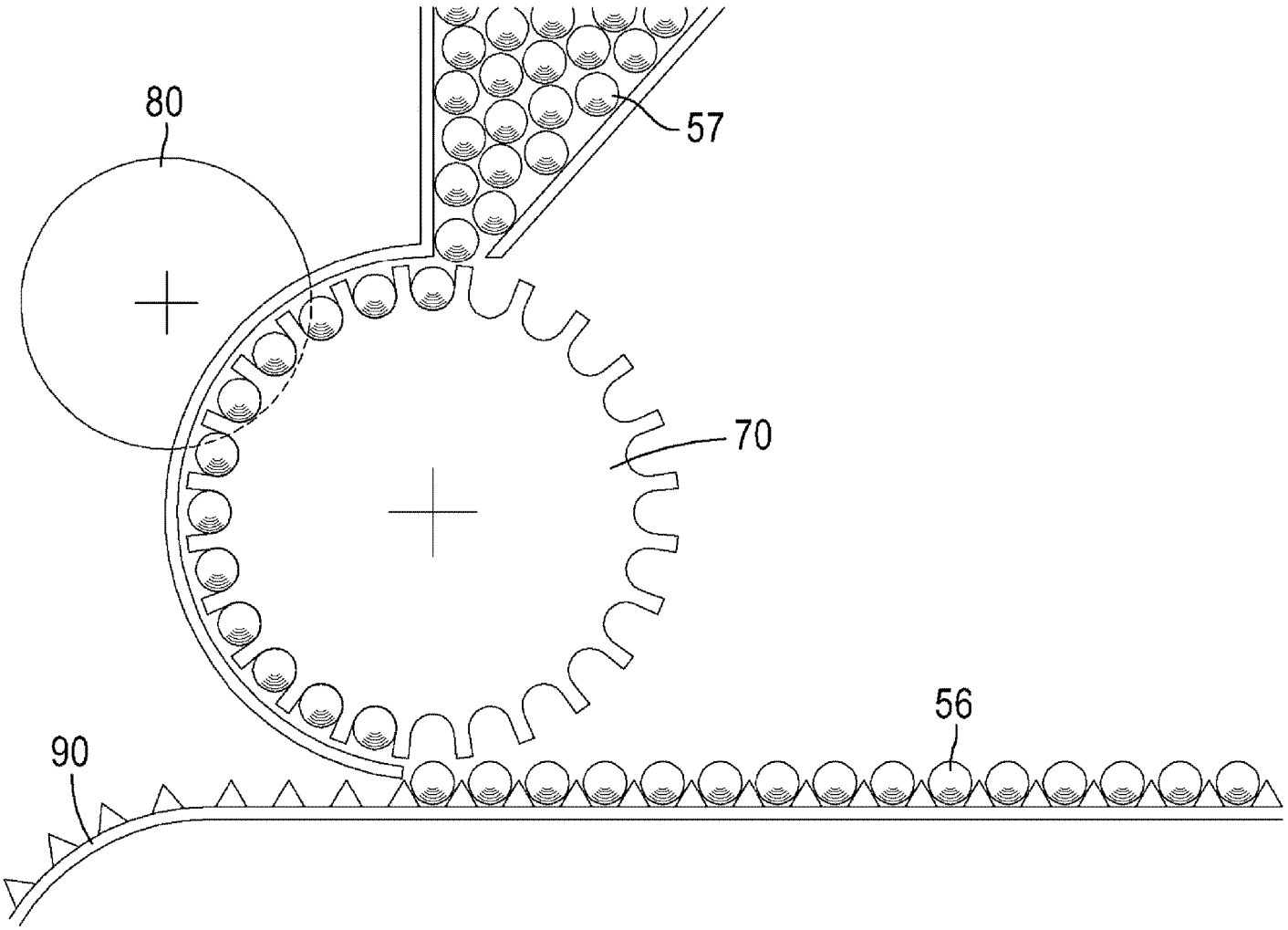
FIG. 4 conceptually shows a process of cutting an absorbent rod in order to manufacture a liquid cartridge according to the present invention from the absorbent rod of FIG. 3.

FIG. 4 is a view schematically illustrating a process of cutting the above-obtained absorbent rod 57 in order to manufacture a liquid cartridge 56 according to a preferred embodiment of the present invention. As described previously, the absorbent rod 57, which is 140 mm, 100 mm, or 80 mm long, for example, may be inserted into a groove in an index table 70 and moved to a conveyor belt 90 by the rotation of the index table. At this point, rotary blades 80 are placed on the moving path along the index table 70, and the absorbent rod 57 is cut into ten liquid cartridges 56 of a desired length, for example, 14 mm, 10 mm, or 80 mm by the rotary blades. Ten rotary blades 80 may be placed at equal intervals to cut a 140-mm absorbent rod 57 into ten 14-mm liquid cartridges 56, a 100-mm absorbent rod 57 into ten 10-mm liquid cartridges 56, or an 80-mm absorbent rod 57 into ten 8-mm liquid cartridges 56. As described previously, since the same process and equipment used to add flavoring components to the filter in the conventional manufacturing of cigarettes are employed, there will be no significant difficulties in achieving mass production and quality control.

According to a preferred embodiment of the present invention, the filter 52 functioning as a mouthpiece is located at the downstream end of the liquid cartridge 56, and the tobacco filler 58 containing shredded tobacco is located at the upstream end of the liquid cartridge 56. By packing these segments (filter, liquid cartridge, and tobacco filler) together, an electrically heated smoking article 50 for generating an aerosol can be made. As described previously, if necessary, the tube 54 which provides an aerosol passage and cools aerosols may be located between the filter 52 and the liquid cartridge 56. All of these segments—filter 52, tube 54, liquid cartridge 56, and tobacco filler 58—are arranged side by side and packed together, thereby obtaining an electrically heated smoking article 50 for generating an aerosol. In an actual manufacturing line, 10 or more sets of these segments are arranged and wrapped, and then cut into a number of electrically heated smoking articles.

In any case, the liquid composition in the liquid cartridge 56 remains absorbed in the absorbent **56*a* in the liquid cartridge, and does not flow out of the liquid cartridge 56. Nevertheless, in the process of manufacturing an electrically heated smoking article or after completing the electrically heated smoking article, a dried liquid composition may flow out due to high-temperature heat or physical pressure applied to the liquid cartridge, or may be vaporized into an aerosol and exit to the outside. First of all, according to a preferred embodiment of the present invention, the tobacco filler is located upstream of the liquid cartridge, and the filter is located downstream of the liquid cartridge, and therefore it is extremely unlikely that the dried liquid composition may flow out through the filter or tobacco filler even if external physical force is applied to the liquid cartridge. Since the liquid composition starts to generate an aerosol at about 120° C. or higher, any loss of the liquid composition during the manufacturing process can be prevented by performing process control at 100° C. or lower in the process of wrapping or making the liquid cartridge 56**. In cases where a high temperature equal to or higher than a temperature where the liquid composition starts to vaporize is required during the manufacturing process, the liquid composition may be controlled in such a way that it is additionally absorbed by estimating the amount of liquid composition lost during the process and adding the estimated amount of loss to a required amount of liquid composition.

Hereinafter, embodiments of an aerosol generating device 100 for generating an aerosol by heating the electrically heated smoking article 50 according to the present invention will be described. The aerosol generating device 100 to be described below is a grippable and portable-sized aerosol generating device that comprises an aerosol-forming substrate such as a liquid composition or shredded tobacco within the smoking article, as in the electrically heated smoking article 50 according to the present invention, has a cavity into which the electrically heated smoking article 50 wrapped in wrapping paper in the shape of a traditional cigarette is inserted, and forms an aerosol by heating the aerosol-forming substrate of the smoking article inserted into the cavity by a heater provided in the aerosol generating device. As stated below, the heater may be a resistance heater or induction heater, which may be heated up to 100 to 400° C. to heat the aerosol-forming substrate within the electrically heated smoking article 50 inserted into the cavity of the aerosol generating device, thereby generating an aerosol. According to a preferred embodiment, the target temperature may range between 200 and 350° C., and more preferably, between 250 and 320° C. (for example, the target temperature may be set to 280° C.). In some cases, the target temperature may range between 150 and 250° C. (for example, the target temperature may be set to 180° C.), and may vary depending on whether an aerosol is generated from the liquid composition (glycerin, etc.), the tobacco filler, or the tobacco filler with the liquid composition such as glycerin absorbed in it. In any of theses cases, an aerosol generated in the electrically heated smoking article 50 is inhaled into the mouth of the user through the tube 54 and the filter 52. Thus, if the temperature of the generated aerosol is too high, even if the aerosol is cooled through the inhalation, the user may feel discomfort or get burned. Moreover, too much aerosol may be generated, making it difficult to take multiple puffs. With this taken into consideration, the target temperature of a heating element should be preset. For these reasons, the above upper limit is set on the target temperature of the heating element.

According to a preferred embodiment, the temperature of a generated aerosol measured after it passes through the tube 54 and the filter 52 may be a mouth end temperature. The temperature of the aerosol should be lower than 50° C., preferably, 45° C. or lower. A desirable temperature range for the aerosol at the mouth end is 25 to 45° C., and a more desirable temperature range for the aerosol at the mouth end is 30 to 40° C.

Figure 5:
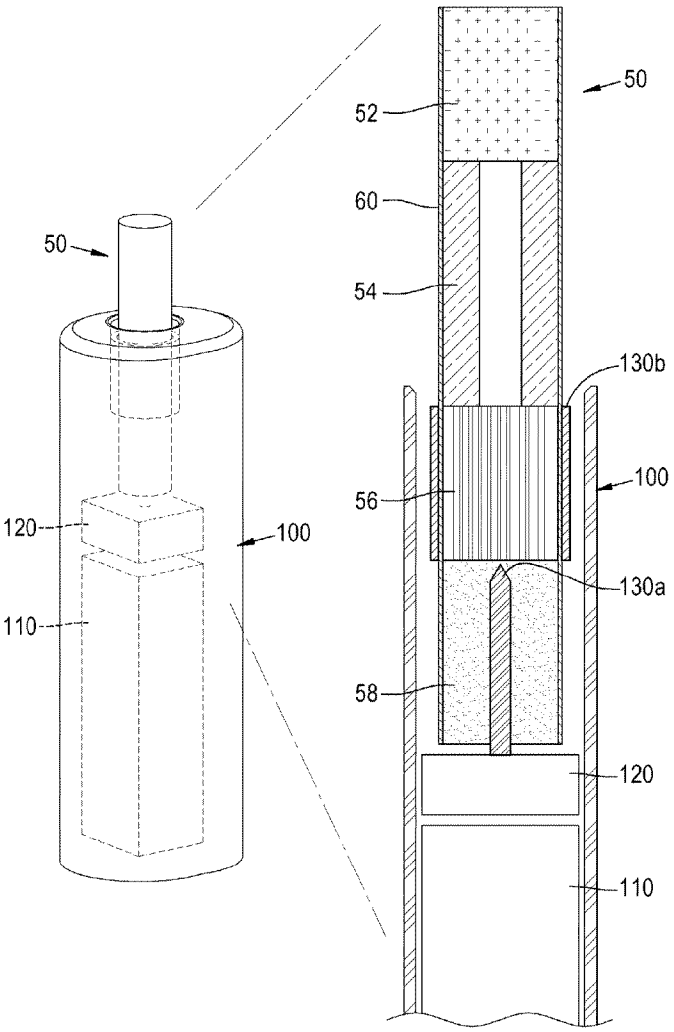
FIGS. 5 through 12 are conceptual diagrams given below to show various embodiments of an aerosol generating device for generating an aerosol from the electrically heated smoking article according to the present invention.

The aerosol generating device 100 commonly comprises a rechargeable battery 110 that is provided into the device and functions as a DC power source and a control unit 120 that controls the output from the battery 110. FIG. 5 depicts a conceptual diagram of the aerosol generating device 100, together with the electrically heated smoking article 50, and schematically shows a cross-section of the aerosol generating device 100 to explain the heating method for each embodiment. For convenience of explanation, the electrically heated smoking article 50 will be described basically with respect to a construction in which the filter 52, the tube 54, the liquid cartridge 56, and the tobacco filler 58 are arranged in the order named and wrapped in the wrapping paper 60. It should be noted that, as explained earlier, the relative positions of the liquid cartridge 56 and tobacco filler 58 may be reversed.

The following descriptions are provided only for illustrative purposes, and the scope of the present invention is not limited thereto. Those skilled in the art to which the present invention pertains will easily understand that an aerosol generating system within the scope of the present invention can be constructed by deleting or adding some of the components of the aerosol generating device exemplified below or combining it with another device.

As stated above, FIG. 5 is a view schematically illustrating a cross-section of an aerosol generating device 100 according to a first embodiment of the present invention, along with a conceptual diagram of an exemplary aerosol generating system to which the present invention may apply.

The aerosol generating system comprise an aerosol generating device 100 and an electrically heated smoking article 50. Here, the electrically heated smoking article 50 is constructed by wrapping the filter 52, paper tube 54, liquid cartridge 56, and tobacco filler 58 in the wrapping paper 60, as described above, and is inserted into a cavity formed in the aerosol generating device 100.

The aerosol generating device 100 comprises a pipe heater 130*b* using electrical resistance, for generating an aerosol by heating a liquid composition absorbed by the liquid cartridge 56, and an invasive heater 130*a* using electrical resistance, for generating an aerosol by heating the shredded tobacco, etc. in the tobacco filler 58. Additionally, the aerosol generating device 100 comprises a battery 110 for supplying power to the heaters 130*a* and 130*b* and a control unit 120 configured to control the power supply to the heaters 130*a* and 130*b* from the battery 110.

The above-mentioned invasive heater 130*a* according to the first embodiment may be in the shape of a blade or stick needle with a heater pattern printed on the outside. In any case, a temperature sensor pattern, along with the heater pattern, may be provided so as to sense the temperature on the surface of the invasive heater 130*a* and control the power supply to the invasive heater 130*a* according to the sensed value. In a case where the invasive heater is inserted into the tobacco filler 58 and heats the tobacco filler 58 to form an aerosol inside the tobacco filler 58, as in the first embodiment, it may help immediately generate an aerosol since it heats the tobacco filler 58 by contact with the tobacco filler 58. As described above, the liquid cartridge 56 is formed by crumpling or rolling physically connected materials; therefore, there is a possibility that the invasive heater 130*a* may not be properly inserted and, even if so, the absorbent may not be properly separated when the invasive heater 130*a* is removed. Thus, it is desirable that the invasive heater 130*a* be inserted only as far as the tobacco filler 58.

Likewise, the above-mentioned pipe heater 130*b* according to the first embodiment is a pipe with a heater line or planar heating element pattern printed or provided on the outside. Like the invasive heater 130*a*, the pipe heater 130*b* has a temperature sensor pattern so as to sense the temperature and control the power supply to the pipe heater 130*b* according to the sensed value. The pipe heater 130*b* heats the liquid cartridge 56 of the electrically heated smoking article 50 from the side of the liquid cartridge 56 so that an aerosol is generated as the liquid composition soaking through or dampening the liquid cartridge is heated.

An aerosol may be generated by heating an aerosol-forming substrate within a temperature range of 150 to 350° C. by the above heaters, and the generated aerosol is inhaled through the mouth of the user via the paper tube 54 and the filter 52. In an example, the invasive heater 130*a* may heat the shredded tobacco in the tobacco filler 58 within a temperature range of 150 to 250° C. to generate an aerosol derived from the shredded tobacco, and the pipe heater 130*b* may heat the absorbent in the liquid cartridge 56 within a temperature range of 250 to 350° C. to generate an aerosol derived from the liquid composition in the absorbent. The above temperature conditions may be reversed. Within the above temperature range, the wrapping paper is not combusted but may be partially scorched.

Needless to say, the heater patterns of the heaters 130*a* and 130*b*, the sensing unit, and the control unit are electrically connected, and the battery and the control unit also are electrically connected.

Figure 6:
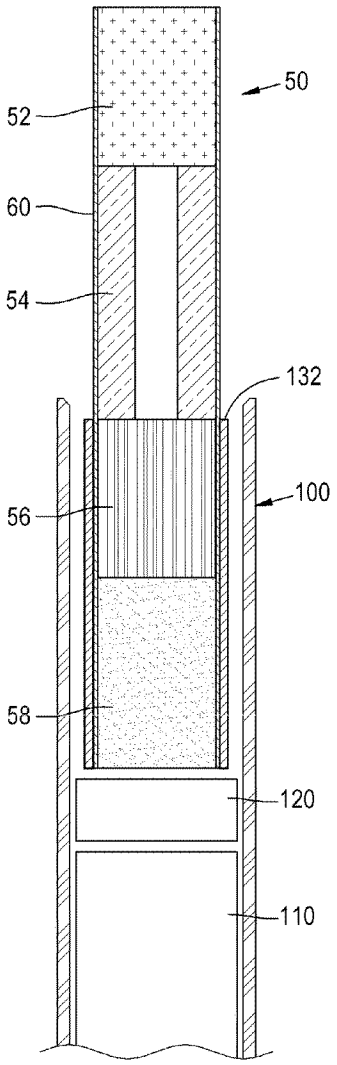

FIG. 6 is a view schematically illustrating a cross-section of an aerosol generating system according to a second embodiment of the present invention.

The electrically heated smoking article 50 is constructed in the same manner as in the first embodiment.

An aerosol generating device 100 according to the second embodiment has a single resistance pipe heater 132 corresponding to the liquid cartridge 56 and tobacco filler 58. Like the pipe heater 130*b* according to the above-described first embodiment, this pipe heater is a pipe with a heater line or planar heating element pattern printed or provided on the outside. The pipe heater 132 according to the second embodiment also has a temperature sensor pattern so as to sense the temperature and control the power supply to the pipe heater 132 according to the sensed value. The pipe heater 132 heats the liquid cartridge 56 of the electrically heated smoking article 50 from the side of the liquid cartridge 56 to generate an aerosol from the liquid composition soaking through or dampening the liquid cartridge, and also heats the tobacco filler 58 of the electrically heated smoking article 50 from the side of the tobacco filler 58 to generate an aerosol from the shredded tobacco, etc. in the tobacco filler 58. The pipe heater 132 of the second embodiment heats the liquid cartridge 56 and the tobacco filler 58 to basically the same temperature. The target temperature may be within a temperature range of 150 to 350° C., and may be adjusted according to the sensed temperature. Within the above temperature range, the wrapping paper is not combusted but may be partially scorched.

In order for the electrically heated smoking article to be used in this device, the amount of aerosol generated from the liquid composition and the amount of aerosol generated from the shredded tobacco may be properly adjusted by adjusting the relative positions of the liquid cartridge 56 and tobacco filler 58 or their relative volumes (or heights).

Needless to say, the heater pattern of the pipe heater 132, the sensing unit, and the control unit 120 are electrically connected, and the battery and the control unit also are electrically connected. It is desirable that the pipe heater 132 only covers the liquid cartridge 56 and the tobacco filler 58 but not the paper tube 54 or the filter 52.

Figure 7:
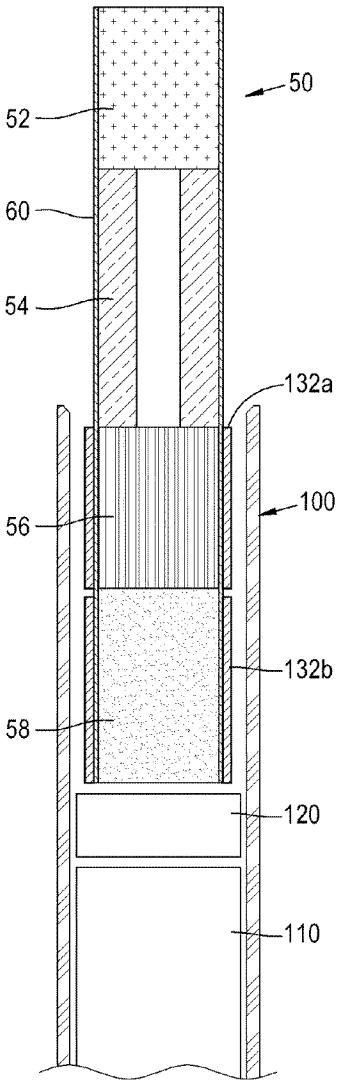

FIG. 7 is a view schematically illustrating a cross-section of an aerosol generating system according to a third embodiment of the present invention.

The electrically heated smoking article 50 is constructed in the same manner as in the foregoing embodiment.

An aerosol generating device 100 according to the third embodiment has a resistance pipe heater 132*a* corresponding to the liquid cartridge 56 and a resistance pipe heater 132*b* corresponding to the tobacco filler 58. Like the pipe heater according to the above-described embodiment, these pipe heaters are pipes with a heater line or planar heating element pattern printed or provided on the outside. The pipe heaters 132*a* and 132*b* according to the third embodiment also have a temperature sensor pattern so as to sense the temperature and control the power supply to the pipe heaters 132*a* and 132*b* according to the sensed value. The pipe heater 132*a* heats the liquid cartridge 56 of the electrically heated smoking article 50 from the side of the liquid cartridge 56 to generate an aerosol from the liquid composition soaking through or dampening the liquid cartridge, and the pipe heater 132*b* heats the tobacco filler 58 of the electrically heated smoking article 50 from the side of the tobacco filler 58 to generate an aerosol from the shredded tobacco, etc. in the tobacco filler 58. The pipe heaters 132*a* and 132*b* of the third embodiment allow the liquid cartridge 56 and the tobacco filler 58 to be heated to different temperatures. The target temperature may be within a temperature range of 150 to 350° C., and may be adjusted according to the sensed temperature. The generated aerosol is inhaled through the mouth of the user via the paper tube 54 and the filter 52. In an example, the pipe heater 132*b* may heat the shredded tobacco in the tobacco filler 58 within a temperature range of 150 to 250° C. to generate an aerosol derived from the shredded tobacco, and the pipe heater 132*a* may heat the absorbent in the liquid cartridge 56 within a temperature range of 250 to 350° C. to generate an aerosol derived from the liquid composition in the absorbent. The above temperature conditions may be reversed. Within the above temperature range, the wrapping paper is not combusted but may be partially scorched.

By employing the construction of the third embodiment, it is possible to properly generate an aerosol from the liquid cartridge 56 and the tobacco filler 58, in an electrically heated smoking article that has the construction shown in the drawing, or in an electrically heated smoking article in which the relative positions of the liquid cartridge 56 and tobacco filler 58 are reversed, without problems with the invasive heater (such as having residues coming off from the electrically heated smoking article after use or not being easily inserted into the liquid cartridge), and it is also possible to set and control the temperatures of the pipe heaters 132*a* and 132*b* to an optimum temperature for each aerosol-forming substrate to generate an aerosol.

Needless to say, the heater pattern of the pipe heaters 132*a* and 132*b*, the sensing unit, and the control unit 120 are electrically connected, and the battery and the control unit also are electrically connected. It is desirable that the pipe heaters 132*a* and 132*b* only cover the liquid cartridge 56 and the tobacco filler 58 but not the paper tube 54 or the filter 52.

Figure 8:
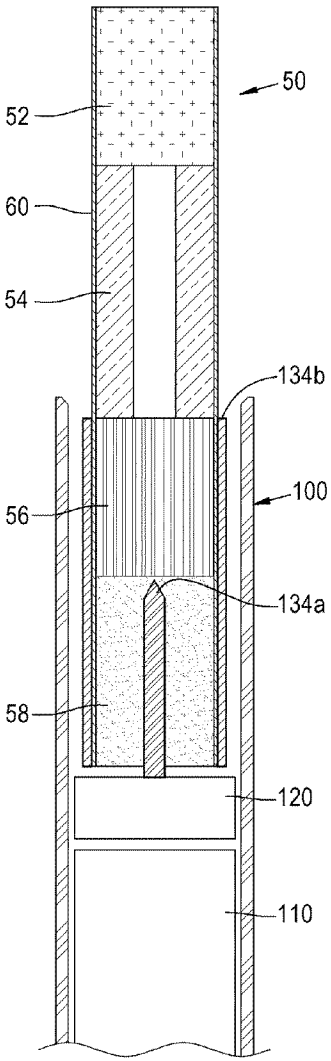

FIG. 8 is a view schematically illustrating a cross-section of an aerosol generating system according to a fourth embodiment of the present invention.

The electrically heated smoking article 50 is constructed in the same manner as in the foregoing embodiment.

An aerosol generating device 100 according to the fourth embodiment has a single resistance pipe heater 134*b* corresponding in height to the liquid cartridge 56 and tobacco filler 58 and an invasive heater 134*a* that can be inserted into the tobacco filler 58.

Like the above-described pipe heater, the pipe heater 134*b* has a heater line or planar heating element pattern printed or provided on the outside, and also has a temperature sensor pattern so as to sense the temperature and control the power supply to the pipe heater 134*b* according to the sensed value. The pipe heater 134*b* heats the liquid cartridge 56 of the electrically heated smoking article 50 from the side of the liquid cartridge 56 to generate an aerosol from the liquid composition soaking through or dampening the liquid cartridge, and also heats the tobacco filler 58 of the electrically heated smoking article 50 from the side of the tobacco filler 58 to generate an aerosol from the shredded tobacco, etc. in the tobacco filler 58. The pipe heater 134*b* of the fourth embodiment heats the liquid cartridge 56 and the tobacco filler 58 to basically the same temperature. However, unlike the second embodiment, the fourth embodiment provides the invasive heater 134*a* having the same construction as described above, that can be inserted into the tobacco filler 58. With this construction, an additional heating source can be provided to the tobacco filler 58, which means that it is possible to better cope with the aerosol-forming substrate provided in the electrically heated smoking article. In any case, the target temperature may be within a temperature range of 150 to 350° C., and may be adjusted according to the sensed temperature. In an example, the pipe heater 134*b* may heat the liquid composition soaking through or dampening the absorbent in the liquid cartridge 56 and the shredded tobacco in the tobacco filler 58 within a temperature range of 150 to 250° C. to generate an aerosol derived from them, and, additionally, the invasive heater 134*a* may heat the shredded tobacco in the tobacco filler 58 within a temperature range of 250 to 350° C. to generate an aerosol derived from the shredded tobacco. The above temperature conditions may be reversed. Within the above temperature range, the wrapping paper is not combusted but may be partially scorched.

Needless to say, the heater patterns of the invasive heater 134*a* and pipe heater 134*b*, the sensing unit, and the control unit 120 are electrically connected, and the battery and the control unit also are electrically connected. It is desirable that the pipe heater 134*b* only covers the liquid cartridge 56 and the tobacco filler 58 but not the paper tube 54 or the filter 52. It is desirable that the invasive heater 134*a* is inserted only into the tobacco filler 58 due to the above-mentioned reason.

FIGS. 9 through 12 illustrate an aerosol generating system to which an induction heater is applied, according to fifth through eighth embodiments of the present invention. The electrical components used for induction heating are parts for induction heating, which include an excitation coil 136*a*, 136*c*, 138*b*, 140*a*, and 140*b* wound multiple times in a cylindrical shape, and a susceptor (magnetic heating element) which reacts with the excitation coil 136*a*, 136*c*, 138*b*, 140*a*, and 140*b* so that induction heating occurs due to eddy current losses. Here, the susceptor is a metal heat pipe 135, 136*d*, 138*a*, 142*a*, and 142*b* provided inside the excitation coil 136*a*, 136*c*, 138*b*, 140*a*, and 140*b* to be surrounded by the excitation coil 136*a*, 136*c*, 138*b*, 140*a*, and 140*b* in the device, which is made of a hollow cylindrical thin plate defining a cavity into which the electrically heated smoking article 50 can be inserted, and which is heated to a temperature of 400° C. or lower by induction heating due to eddy current losses, by reaction with the excitation coil 136*a*, 136*c*, 138*b*, 140*a*, and 140*b*. The susceptor may be heated to a temperature of 1,000° C. or higher depending on the magnitude of the alternating current applied to the excitation coil 136*a*, 136*c*, 138*b*, 140*a*, and 140*b*, whereas, in the present invention, the susceptor functioning as a heating element is heated to a temperature of 400° C. or lower, as stated above. The temperature of the heat pipe 135, 136*d*, 138*a*, 142*a*, and 142*b* may be sensed by a temperature sensor that makes physical contact with the surface of the heat pipe 135, 136*d*, 138*a*, 142*a*, and 142*b*, or the temperature of the susceptor may be calculated based on current and voltage changes detected by a current sensor and voltage sensor which measure changes in the current and voltage for heating the susceptor depending on the inductance or reactance varying with changes in the temperature of the susceptor functioning as the heat pipe 135, 136*d*, 138*a*, 142*a*, and 142*b*.

In order for induction heating to occur, the control unit receives direct current power from the battery 110 and supplies an alternating current having a resonance frequency or an alternating current having a frequency different from the resonance frequency to the excitation coil. By controlling the alternating current applied to the excitation coil based on changes in the temperature of the susceptor, the susceptor may be heated to a desired temperature, be maintained at that temperature, or have temperature changes.

Figure 9:
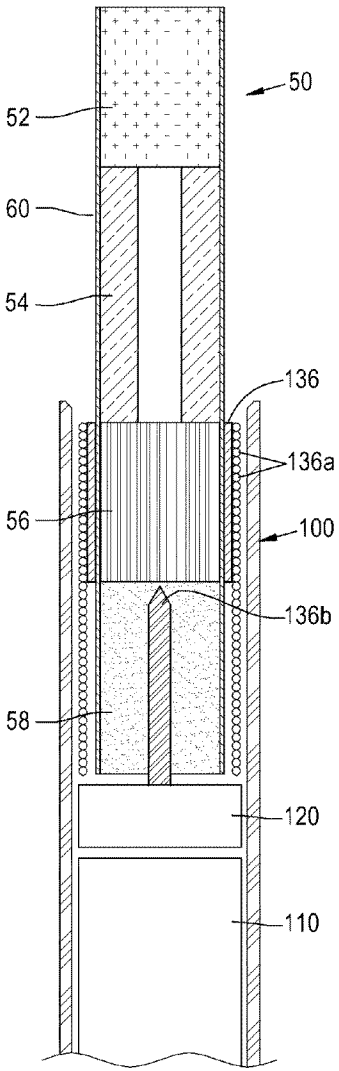

FIG. 9 is a view schematically illustrating a cross-section of an aerosol generating system according to a fifth embodiment of the present invention.

The electrically heated smoking article 50 is constructed in the same manner as in the foregoing embodiment.

An aerosol generating device 100 according to the fifth embodiment has an induction heat pipe 135 corresponding to the liquid cartridge 56 and an induction heat blade 136*b* corresponding to the tobacco filler 58. Both the heat pipe 135 and the heat blade 136*b* are constructed of a susceptor, and are heated by induction heating. The heat pipe 135 heats the liquid cartridge 56 of the electrically heated smoking article 50 from the side of the liquid cartridge 56 to generate an aerosol from the liquid composition soaking through or dampening the liquid cartridge, and the heat blade 136*b* heats the shredded tobacco in the tobacco filler 58 of the electrically heated smoking article 50 to generate an aerosol.

Since the heat pipe 135 and heat blade 136*b* functioning as a susceptor are provided separately, a desired heating temperature condition can be achieved by adjusting their material or thickness.

The temperature condition to be achieved by control may be the same as or similar to what has been stated earlier. That is, the heat pipe 135 and heat blade 136*b* of the fifth embodiment allow the liquid cartridge 56 and the tobacco filler 58 to be heated to different temperatures. The target temperature may be within a temperature range of 150 to 300° C., and may be adjusted according to the sensed temperature. The generated aerosol is inhaled through the mouth of the user via the paper tube 54 and the filter 52. In an example, the heat blade 136*b* may heat the shredded tobacco in the tobacco filler 58 within a temperature range of 150 to 200° C. to generate an aerosol derived from the shredded tobacco, and the heat pipe 135 may heat the absorbent in the liquid cartridge 56 within a temperature range of 250 to 300° C. to generate an aerosol derived from the liquid composition in the absorbent. The above temperature conditions may be reversed. Within the above temperature range, the wrapping paper is not combusted but may be partially scorched.

Needless to say, the excitation coil 136*a*, the sensing unit, and the control unit 120 are electrically connected, and the battery and the control unit also are electrically connected. It is desirable that the heat pipe 135 only covers the liquid cartridge 56 but not the paper tube 54 or the filter 52. Also, it is desirable that the heat blade 136*b* be inserted only as far as the tobacco filler 58, like the electrical resistance-type invasive heater.

Figure 10:
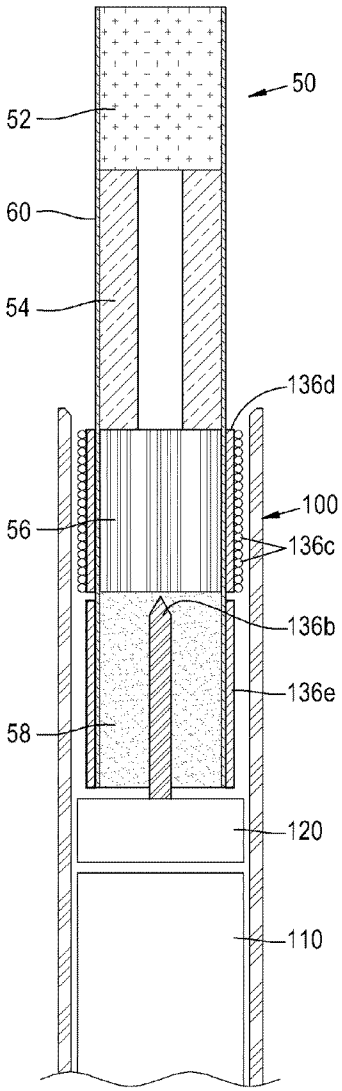

FIG. 10 is a view schematically illustrating a cross-section of an aerosol generating system according to a sixth embodiment of the present invention.

The electrically heated smoking article 50 is constructed in the same manner as in the foregoing embodiment.

An aerosol generating device 100 according to the sixth embodiment is an example of a combination of an induction heat pipe 136*d* corresponding to the liquid cartridge 56 and a resistance pipe heater 136*e* corresponding to the tobacco filler 58.

The heat pipe 136*d* functioning as a susceptor heats the liquid cartridge 56 of the electrically heated smoking article 50 from the side of the liquid cartridge 56 to generate an aerosol from the liquid composition soaking through or dampening the liquid cartridge.

Also, the resistance pipe heater 136*e* heats the tobacco filler 58 of the electrically heated smoking article 50 from the side of the tobacco filler 58 to generate an aerosol from the shredded tobacco, etc. in the tobacco filler 58.

In order for the electrically heated smoking article to be used in this device, the amount of aerosol generated from the liquid composition and the amount of aerosol generated from the shredded tobacco may be properly adjusted by adjusting the relative positions of the liquid cartridge 56 and tobacco filler 58 or their relative volumes (or heights).

The heat pipe 136*d* and pipe heater 136*e* of the sixth embodiment allow the liquid cartridge 56 and the tobacco filler 58 to be heated to different temperatures. The target temperature may be within a temperature range of 150 to 350° C., and may be adjusted according to the sensed temperature. The generated aerosol is inhaled through the mouth of the user via the paper tube 54 and the filter 52. In an example, the heat pipe 136*d* may heat the shredded tobacco in the tobacco filler 58 within a temperature range of 150 to 250° C. to generate an aerosol derived from the shredded tobacco, and the pipe heater 136*e* may heat the absorbent in the liquid cartridge 56 within a temperature range of 250 to 350° C. to generate an aerosol derived from the liquid composition in the absorbent. The above temperature conditions may be reversed. Within the above temperature range, the wrapping paper is not combusted but may be partially scorched.

Needless to say, the excitation coil 136*c*, the heater pattern of the pipe heater 136*e*, the sensing unit, and the control unit 120 are electrically connected, and the battery and the control unit also are electrically connected. It is desirable that the heat pipe 136*d* and the pipe heater 136*e* only cover the liquid cartridge 56 and the tobacco filler 58 but not the paper tube 54 or the filter 52.

Figure 11:
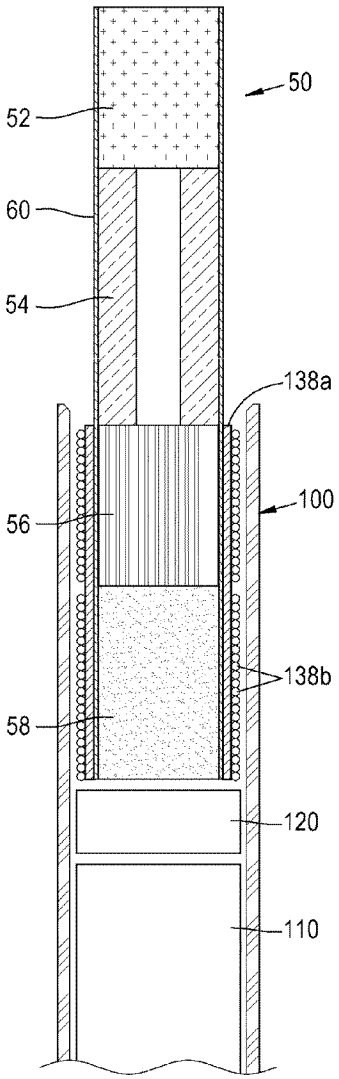

FIG. 11 is a view schematically illustrating a cross-section of an aerosol generating system according to a seventh embodiment of the present invention.

The electrically heated smoking article 50 is constructed in the same manner as in the foregoing embodiment.

The aerosol generating device 100 according to the seventh embodiment works by heating both the liquid cartridge 56 and the tobacco filler 58 by an induction heat pipe 138*a*. As the heat pipe 138*a* is heated, an aerosol is generated from the liquid composition soaking through or dampening the absorbent in the liquid cartridge 56, and, at the same time, an aerosol is generated from the shredded tobacco, etc. in the tobacco filler 58. The heat pipe 138*a* of the seventh embodiment heats the liquid cartridge 56 and the tobacco filler 58 to basically the same temperature. The target temperature may be within a temperature range of 150 to 350° C., and may be adjusted according to the sensed temperature. Within the above temperature range, the wrapping paper is not combusted but may be partially scorched.

In order for the electrically heated smoking article to be used in this device, the amount of aerosol generated from the liquid composition and the amount of aerosol generated from the shredded tobacco may be properly adjusted by adjusting the relative positions of the liquid cartridge 56 and tobacco filler 58 or their relative volumes (or heights).

Needless to say, the excitation coil 138*b*, the sensing unit, and the control unit 120 are electrically connected, and the battery and the control unit also are electrically connected. It is desirable that the heat pipe 138*a* only covers the liquid cartridge 56 and the tobacco filler 58 but not the paper tube 54 or the filter 52.

Figure 12:
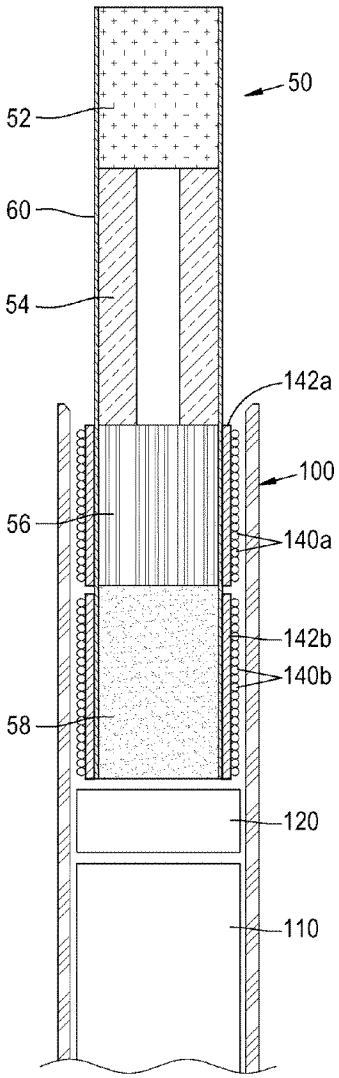

FIG. 12 is a view schematically illustrating a cross-section of an aerosol generating system according to an eighth embodiment of the present invention. The electrically heated smoking article 50 is constructed in the same manner as in the foregoing embodiment.

An aerosol generating device 100 according to the eighth embodiment has an induction heat pipe 142*a* corresponding to the liquid cartridge 56 and an induction heat pipe 142*b* corresponding to the tobacco filler 58. Excitation coils 140*a* and 140*b* for heating them by induction are provided respectively. The heat pipe 142*a* heats the liquid cartridge 56 of the electrically heated smoking article 50 from the side of the liquid cartridge 56 to generate an aerosol from the liquid composition soaking through or dampening the liquid cartridge, and the heat pipe 142*b* heats the tobacco filler 58 of the electrically heated smoking article 50 from the side of the tobacco filler 58 to generate an aerosol from the shredded tobacco, etc. in the tobacco filler 58. The heat pipes 142*a* and 142*b* of the eighth embodiment allow the liquid cartridge 56 and the tobacco filler 58 to be heated to different temperatures. The target temperature may be within a temperature range of 150 to 350° C., and may be adjusted according to the sensed temperature. The generated aerosol is inhaled through the mouth of the user via the paper tube 54 and the filter 52. In an example, the heat pipe 142*b* may heat the shredded tobacco in the tobacco filler 58 within a temperature range of 150 to 250° C. to generate an aerosol derived from the shredded tobacco, and the heat pipe 142*a* may heat the absorbent in the liquid cartridge 56 within a temperature range of 250 to 350° C. to generate an aerosol derived from the liquid composition in the absorbent. The above temperature conditions may be reversed. Within the above temperature range, the wrapping paper is not combusted but may be partially scorched.

In order for the electrically heated smoking article to be used in this device, the amount of aerosol generated from the liquid composition and the amount of aerosol generated from the shredded tobacco may be properly adjusted by adjusting the relative positions of the liquid cartridge 56 and tobacco filler 58 or their relative volumes (or heights).

Needless to say, the excitation coils 140*a* and 140*b*, the sensing unit, and the control unit 120 are electrically connected, and the battery and the control unit also are electrically connected. It is desirable that the heat pipes 142*a* and 142*b* only cover the liquid cartridge 56 and the tobacco filler 58 but not the paper tube 54 or the filter 52.

A person with ordinary skill in the art to which the present invention pertains will understand that the present invention may be implemented in a modified form within the scope which does not deviate from the essential characteristics of the present invention. Therefore, the methods disclosed in the above should be considered from an explanatory point of view, not a limited point of view. The scope of the present invention is defined by the claims, not the foregoing description, and all of the differences within the scope equivalent thereto should be interpreted to be included in the scope of the present invention.

According to the present invention, it is possible for the user to inhale an aerosol derived from a liquid and an aerosol derived from a tobacco substrate together, by providing a liquid cartridge that can be inserted into an electrically heated smoking article, an electrically heated smoking article including the same, and an aerosol generating device and system therefor.

What is claimed is:

1. An electrically heated smoking article which is disposed after used once, comprising:

a filter configured as a mouthpiece;

a liquid cartridge located upstream of the filter, the liquid cartridge comprising: a liquid composition that is vaporized into an aerosol by electrically heating the electrically heated smoking article; and an absorbent soaked with the liquid composition; and a tobacco filler containing shredded tobacco located upstream of the filter and located upstream or downstream of the liquid cartridge, wherein the liquid cartridge further comprises wrapping paper wrapped around a side of the liquid absorbent, forming a paper-wrapped and filled cylindrically shaped liquid absorbent measuring 7 to 20 mm long and 5 to 8 mm in diameter and serving as a housing for the liquid cartridge, wherein the wrapping paper comprises aluminum foil attached to paper, and is wrapped in the filled cylindrical shape so that the aluminum foil comes into contact with the absorbent, wherein an amount of liquid composition absorbed by the absorbent per unit volume of the absorbent is 0.13 to 0.32 mg/mm$^3$, such that the liquid composition remains absorbed in the absorbent in the liquid cartridge without flowing out of the liquid cartridge, wherein the filter, the liquid cartridge, and the tobacco filler are wrapped in a separate wrapping paper to form the smoking article, wherein the liquid composition of the liquid cartridge is configured to generate the aerosol by electrically heating the liquid cartridge in a first temperature range and the tobacco filler is configured to generate the aerosol by electrically heating the tobacco filler, separately from the heating of the liquid cartridge, in a second temperature range which is different from the first temperature range, such that a user may inhale the aerosol through the filter.

2. The electrically heated smoking article of claim 1, further comprising a paper tube provided directly upstream of the filter.

3. An aerosol generating device for the electrically heated smoking article of claim 1, and which is grippable within a user's hand and user-portable-sized, the aerosol generating device comprising:

a cavity in the aerosol generating device and into which the liquid cartridge and the tobacco filler of the electrically heated smoking article is configured to be inserted;

a first heater and a second heater being at least one of a resistance heater or an induction heater in the aerosol generating device and configured to heat an interior or exterior of the liquid cartridge and the tobacco filler of the electrically heated smoking article, respectively, wherein the first heater is configured to heat the liquid cartridge of the electrically heated smoking article in the first temperature range and the second heater is configured to heat the tobacco filler of the electrically heated smoking article in the second temperature range;

a rechargeable battery provided in the aerosol generating device and configured to function as a direct current power source; and a control unit provided in the aerosol generating device and configured to control the at least one of the resistance heater or the induction heater by receiving direct current power from the battery.

4. The aerosol generating device of claim 3, wherein the resistance heater is either a pipe heater configured to heat the exterior of the electrically heated smoking article or an invasive heater inserted into the electrically heated smoking article and configured to heat the interior, and wherein the pipe heater is configured to heat the liquid cartridge and/or the tobacco filler, and the invasive heater is inserted into the tobacco filler and configured to heat the interior of the tobacco filler.

5. The aerosol generating device of claim 4, further comprising a temperature sensor provided in the device and configured to sense the temperature of the at least one of the resistance heater or the induction heater, wherein the control unit is configured to control the resistance heater according to a sensed value from the temperature sensor.

6. The aerosol generating device of claim 3, wherein the induction heater is either a heat pipe made of a susceptor material and configured to heat the exterior of the smoking article, heated by an excitation coil provided separately in the aerosol generating device, or a heat blade made of a susceptor material that is inserted into the electrically heated smoking article and configured to heat the interior of the electrically heated smoking article, and wherein the heat pipe is configured to heat the liquid cartridge and/or the tobacco filler, and the heat blade is inserted into the tobacco filler and configured to heat the interior of the tobacco filler.

7. The aerosol generating device of claim 6, further comprising a temperature obtaining unit provided in the device and configured to obtain the temperature of the induction heater, wherein the control unit is configured to control an electrical current applied to the excitation coil based on an input from the temperature obtaining unit.

8. An aerosol generating system, comprising:

the electrically heated smoking article of claim 1; and an aerosol generating device comprising: a cavity into which the liquid cartridge and the tobacco filler of the electrically heated smoking article is configured to be inserted; a first heater and a second heater being at least one of a resistance heater or an induction heater configured to heat an interior or exterior of the liquid cartridge and the tobacco filler of the electrically heated smoking article, respectively, wherein the first heater is configured to heat the liquid cartridge of the electrically heated smoking article in the first temperature range and the second heater is configured to heat the tobacco filler of the electrically heated smoking article in the second temperature range; a rechargeable battery configured to function as a direct current power source; and a control unit configured to control the at least one of a resistance heater or an induction heater by receiving direct current power from the battery, wherein an aerosol is generated inside the electrically heated smoking article by inserting the electrically heated smoking article into the cavity and electrically heating the liquid cartridge and tobacco filler of the electrically heated smoking article.

9. The electrically heated smoking article of claim 1, wherein the liquid composition comprises 70 to 100 wt % glycerin VG (vegetable glycerin).

10. The electrically heated smoking article of claim 1, wherein the liquid composition comprises at least 70 wt % glycerin VG (vegetable glycerin), 20 wt % or less glycerin PG (propylene glycol), 10 wt % or less water, and flavorings added in an amount that is 10% or less of the total weight of the resulting liquid composition.

11. The electrically heated smoking article of claim 1, wherein the liquid absorbent comprises a melamine-based foam resin having a thickness of 2 to 3 mm and a cylindrical shape.

12. The electrically heated smoking article of claim 11, wherein the liquid absorbent has 0.01 to 0.013 $mg/mm^3$.

13. The electrically heated smoking article of claim 1, wherein the liquid absorbent comprises pulp or a fabric containing pulp and has a cylindrical shape.

14. The electrically heated smoking article of claim 1, wherein the liquid absorbent has 0.25 to 0.4 $mg/mm^3$.

15. The electrically heated smoking article of claim 1, wherein the liquid absorbent comprises a cotton fabric having a cylindrical shape.

16. The electrically heated smoking article of claim 15, wherein the liquid absorbent has 0.2 to 0.35 $mg/mm^3$.

17. The electrically heated smoking article of claim 1, wherein the liquid absorbent comprises a bamboo fiber fabric having a cylindrical shape.

18. The electrically heated smoking article of claim 17, wherein the liquid absorbent has 0.15 to 0.25 $mg/mm^3$.

* * * * *